US005183296A

United States Patent [19]

Policht

[11] Patent Number: 5,183,296

[45] **Date of Patent: * Feb. 2, 1993**

[54] PHOTOGRAPH ALBUM AND METHOD FOR MAKING SAME

[75] Inventor: Stanislaw A. Policht, Closter, N.J.

[73] Assignee: Qualex, Fairlawn, N.J.

[ * ] Notice: The portion of the term of this patent subsequent to Aug. 13, 2008 has been disclaimed.

[21] Appl. No.: 761,406

[22] Filed: Sep. 17, 1991

[51] Int. Cl.[5] ..... B42F 3/00

[52] U.S. Cl. ..... 281/46; 40/537; 281/38; 281/21.1; 281/15.1; 281/22; 402/79; 402/501

[58] Field of Search ..... 281/22, 46, 15.1, 21.1, 281/29, 31, 38, 45, 47, 48, 51; 402/79, 80 R, 501; 40/530, 537

[56] References Cited

U.S. PATENT DOCUMENTS 4,659,109 4/1987 Donovan ..... 281/46
5,040,216 8/1991 Policht ..... 281/22

*Primary Examiner*—Timothy V. Eley
*Assistant Examiner*—Willmon Fridie, Jr.
*Attorney, Agent, or Firm*—Bell, Seltzer, Park & Gibson

[57] ABSTRACT

A photograph album for holding a plurality of leaves in a laterally disposed relation to each other. The album includes an elongate generally U-shaped binder for receiving an edge portion of the leaves. The binder includes a first and second retainer hingedly secured to opposing ends of the binder, such as with an integrally molded living hinge. The retainers are movable between an opened and a closed position. In the opened position, the leaves may be inserted into or removed from the binder. In the closed position, the free end of the retainers engage respective slots in the leaves to retain the leaves in the binder. The retainers include outwardly extending tabs to engage respective openings in the binder to thereby lock the retainers in the closed position. Other aspects of the invention includes a cover for the album and a storage folder for holding a plurality of the covered albums. The album is amenable to assembly using automated technology.

21 Claims, 4 Drawing Sheets

PHOTOGRAPH ALBUM AND METHOD FOR MAKING SAME

FIELD OF THE INVENTION

This invention relates to the field of photography, and more particularly to an improved photograph album and method for making the same.

BACKGROUND OF THE INVENTION

A typical photograph album may have a construction like a book or loose-leaf binder with pages of paper onto which the photographs are mounted by various techniques. For example, an adhesive may be used to directly mount the photographs to the album pages, transparent retaining envelopes may be used, or corner mounts glued to the pages may hold the photographs. In these typical albums, the pages themselves add to the bulk of the album and, in addition, such albums may be costly, particularly when sold fully assembled.

A more desirable photograph album for a majority of applications has minimal excess size and weight beyond that which the photographs themselves contribute. The photograph album should be relatively inexpensive to manufacture and assemble, and the purchaser should have the option of whether to buy the photographs fully assembled in the album. The photograph album should also be available in kit form so that the purchaser may prepare his or her own albums.

Photograph albums have been developed in the prior art in an attempt to provide a lightweight and inexpensive album. For example, U.S. Pat. No. 3,116,738 to Wentges, discloses a photograph album having leaves holding photographs with fastening edges stacked together, one above the other. An elastic band is used to secure the leaves together by fitting into slots formed in opposing edges of the leaves. U.S. Pat. No. 4,530,176 to Rejwan similarly discloses an album using an elastic band to secure a stack of leaves together in a plastic binder. Unfortunately, an elastic band may be stretched beyond its elastic limit or may be easily separated from the binder and lost. A further disadvantage of the elastic band is that it is not amenable to automated assembly. Typically, the elastic band must be manually stretched and fitted to the stacked leaves during assembly of the photograph album.

The assignee of the present invention, in an effort to overcome the limitations of the elastic band, has developed and marketed a photograph album wherein fixed end pieces are positioned on opposite ends of an elongate backbone member. The album is disclosed in U.S. Pat. No. 5,040,216 to Policht. The fixed end pieces engage corresponding slots in opposing edges of the leaves holding the photographs. The stacked leaves must be flexed for insertion into or removal from the album.

Despite advancements and improvements in the art, there still exists a need for a lightweight and inexpensive photograph album that may be quickly and easily assembled, disassembled, and reassembled. In addition, assembly of the album should be capable of being readily implemented using automated equipment.

SUMMARY OF THE INVENTION

It is therefore an object of the invention to provide an improved photograph album that is lightweight, relatively inexpensive, and which can be readily assembled using automated technology.

This and other objects of the invention are provided by a photograph album including an elongate generally U-shaped binder and a plurality of leaves holding photographs disposed in a laterally adjacent relationship and positioned within the binder. Each leaf has a first edge portion received within the binder and a first and second slot within and opening outwardly from respective second and third opposite edge portions. The U-shaped binder preferably includes a rectangular top wall and two spaced apart sidewalls depending therefrom for receipt therein of the first edge portion of the leaves.

Unlike prior art albums using an elastic band to hold the leaves together, the invention includes first and second retainers movably secured to the binder adjacent opposite ends thereof. The retainers are movable between an opened position and a closed position. The opened position is for permitting insertion and removal of the leaves and the closed position is for retaining the leaves within the binder by engagement of the free end of the retainers within respective slots of the leaves.

In a preferred embodiment of the invention, the U-shaped binder is plastic. Accordingly, each of the retainers may be hingedly secured to a respective end of the binder by an integrally molded flexible plastic strip. The flexible plastic strip forms a so called "living hinge" for securing the retainers to the binder.

The photograph album may also include locking means for releasably securing the retainers in the closed position. Each of the retainers is generally T-shaped, and the locking means includes a pair of outwardly extending locking tabs adjacent a free end of each T-shaped retainer and corresponding openings in the binder for receiving the locking tabs.

According to another aspect of the invention, a cover may be provided for protecting the leaves in the binder. The cover preferably includes a front panel, a rear panel, and a spine panel therebetween. A retainer clip is positioned adjacent the spine panel on the inside of the cover. The retainer clip includes a set of inwardly extending tabs to engage respective openings in the binder.

Another aspect of the invention is a book-sized storage folder for holding a plurality of covered photograph albums. The storage folder includes a series of slots for receipt therein of the rear panel of the cover for each album. Slots may be provided to receive an album including either standard (e.g., 3 inch) or jumbo (e.g., 4 inch) pictures. In addition, the storage folder preferably includes a negative storage pocket for each album. In one embodiment, the storage folder includes three album mounting panels joined by to hinge panels in a trifold design. Each album mounting panel may hold two covered photograph albums.

The method for making a photograph album according to the present invention is readily adaptable to automated production, yet may also be readily practiced manually by a purchaser. The album is preferably made from a plurality or stack of leaves for holding photographs disposed in laterally adjacent relationship to each other. Each leaf has a first and second slot within and opening outwardly from respective opposing edge portions. A generally U-shaped binder is provided having a first and second retainer movably secured to respective opposing ends of the binder. As described above, the binder channel is formed including an integrally molded flexible plastic strip between the retainers and the binder to form respective hinges therebetween. The retainers are movable between an opened position and a closed position. The stack of leaves is positioned into the binder while the retainers are in the opened position and the retainers are then moved to the closed position to engage the slots of the leaves to secure the leaves in the binder.

DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, applicant provides these embodiments so that this disclosure will be thorough and complete, and will fully convey the scope of the invention to those skilled in the art. Like numbers refer to like elements throughout.

Figure 1:
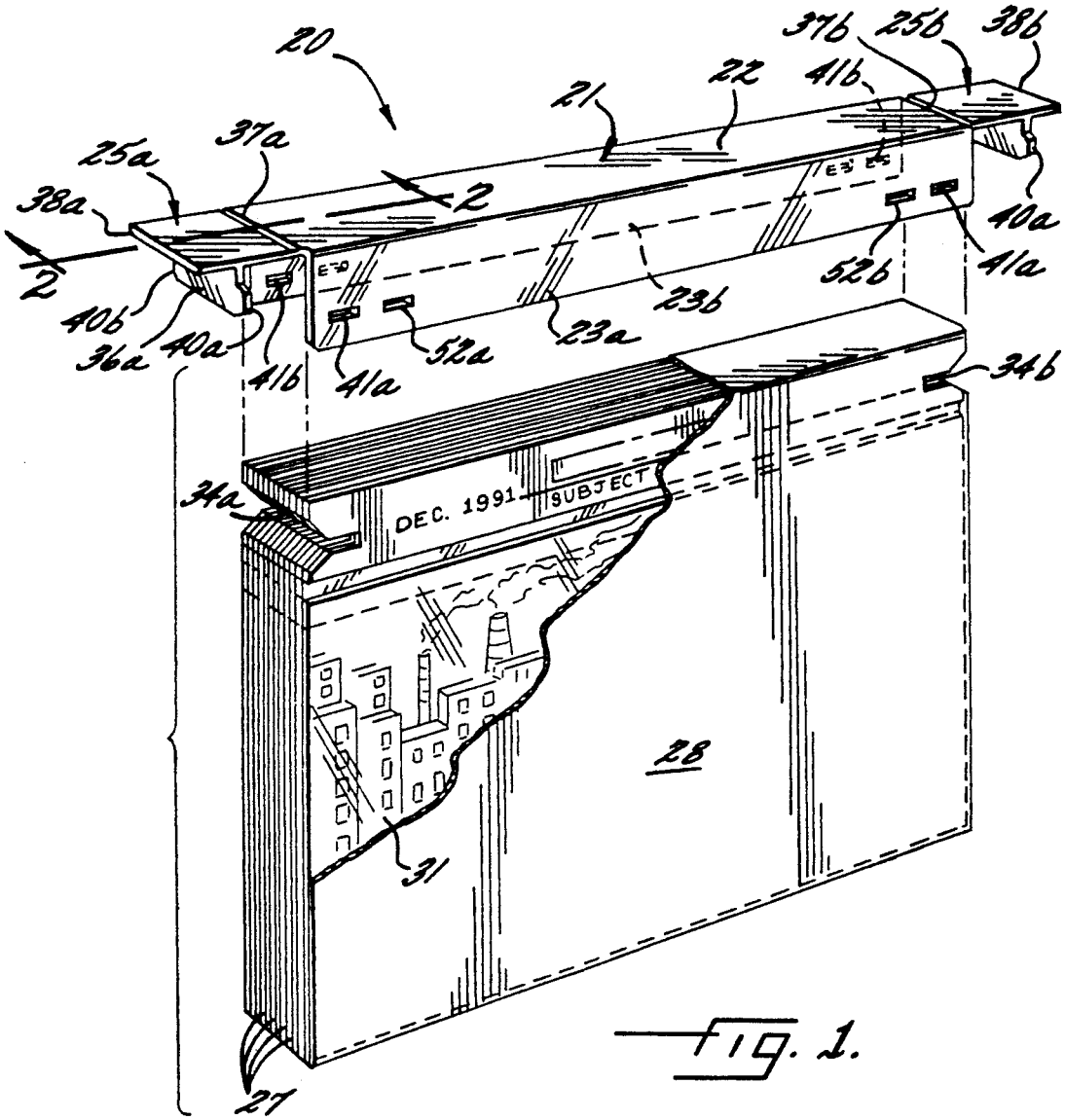
FIG. 1 is an exploded perspective view, partially in section, of a photograph album according to the invention.
Figure 2:
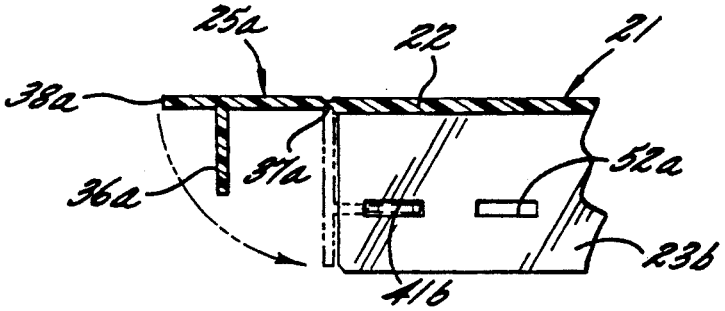
FIG. 2 is an enlarged side elevational view of an end portion of the photograph album shown along lines 2—2 in FIG. 1.
Figure 3:
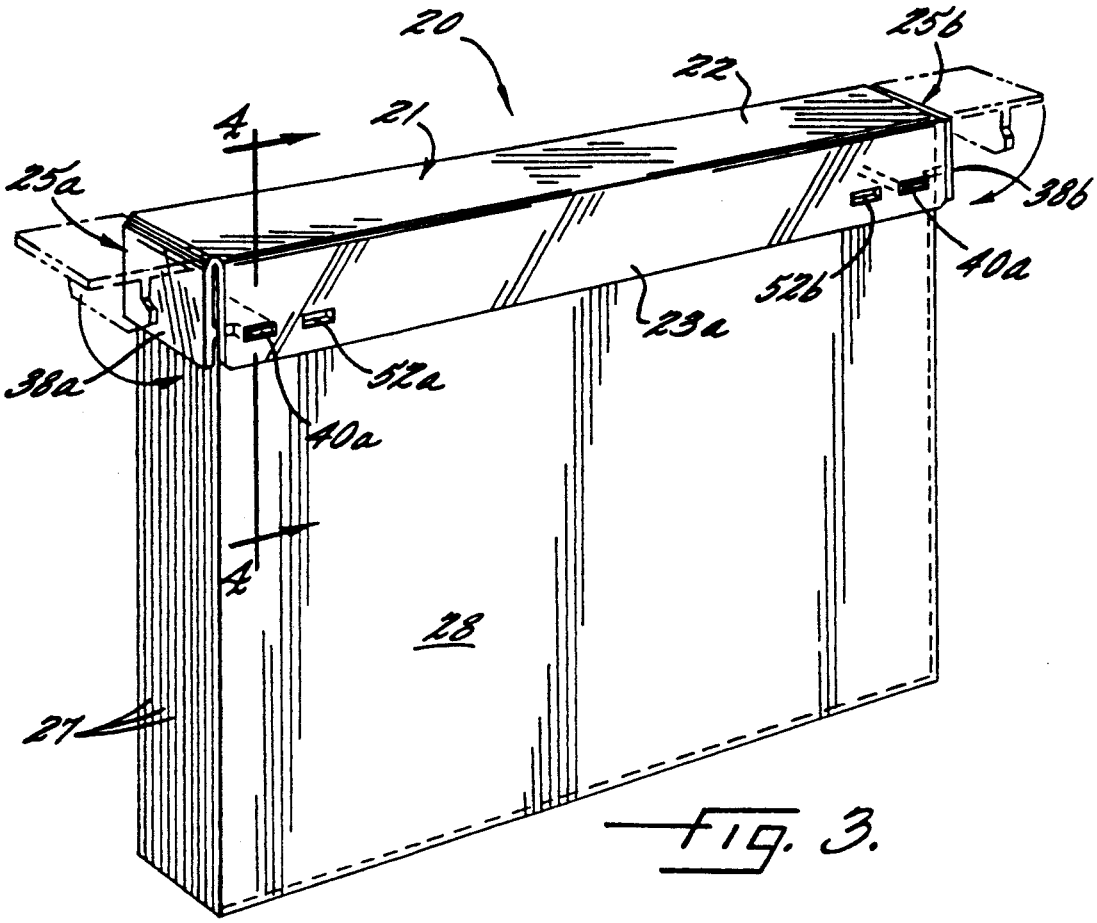
FIG. 3 is a perspective view of the photograph album in FIG. 1 shown in an assembled condition.

Referring to FIGS. 1-5, there is shown a photograph album according to one aspect of the invention being generally designated as 20. The photograph album 20 includes an elongate generally U-shaped binder 21. In the illustrated embodiment, the binder 21 includes a top wall 22 and a pair of opposing sidewalls 23*a*, 23*b*. A first retainer 25*a* and a second retainer 25*b* are hingedly secured to respective opposing ends of the binder 21. The retainers 25*a*, 25*b* are movable between an opened position (FIG. 1) and a closed position (FIG. 3).

In the opened position, a stack of leaves 27 may be inserted into the binder 21. The leaves 27 are for holding photographs 31 disposed in laterally adjacent relation to each other. A thin paperboard cover 28 may be provided to protect the photographs within the binder 21. The cover 28 may be one piece for forming both a front and back cover for the album 20. As shown best in FIG. 5, each leaf includes a plastic strip 30 having a portion of adhesive 32 thereon for securing a photograph 31 thereto. As shown in FIG. 1, the leaves 27 include a first slot 34*a* and a second slot 34*b* within and opening outwardly from respective opposite edge portions of the leaves.

Figure 4:
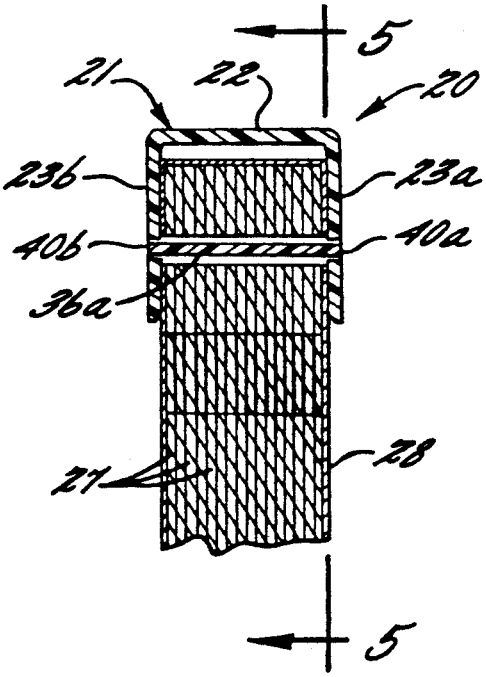
FIG. 4 is an enlarged cross-sectional view of an end portion of the photograph album shown along lines 4—4 in FIG. 3.
Figure 5:
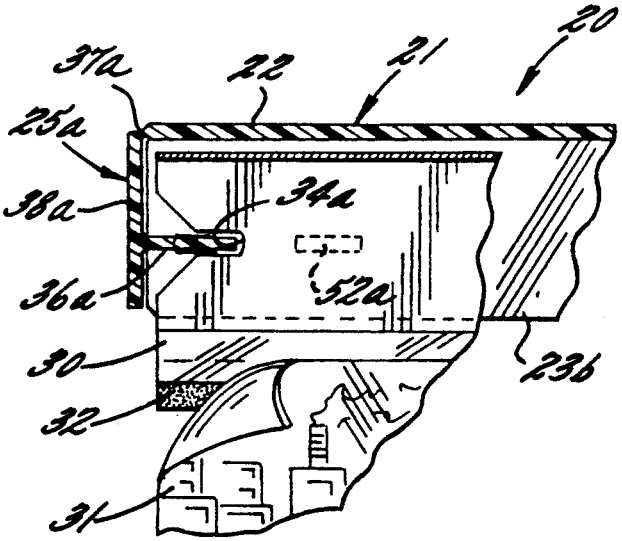
FIG. 5 is a side elevational view, partially in section, of an end portion of the photograph album taken along lines 5—5 of FIG. 4.
Figure 6:
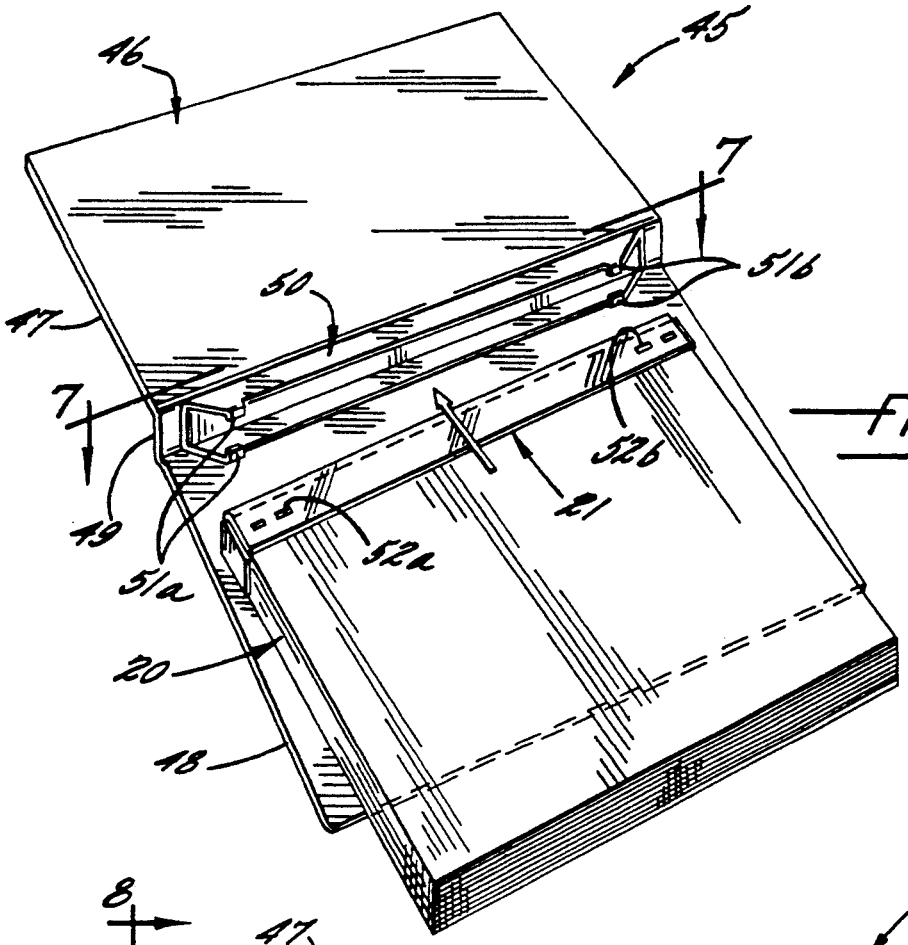
FIG. 6 is a perspective view illustrating insertion of the photograph album of FIG. 1 into a protective cover.
Figure 7:
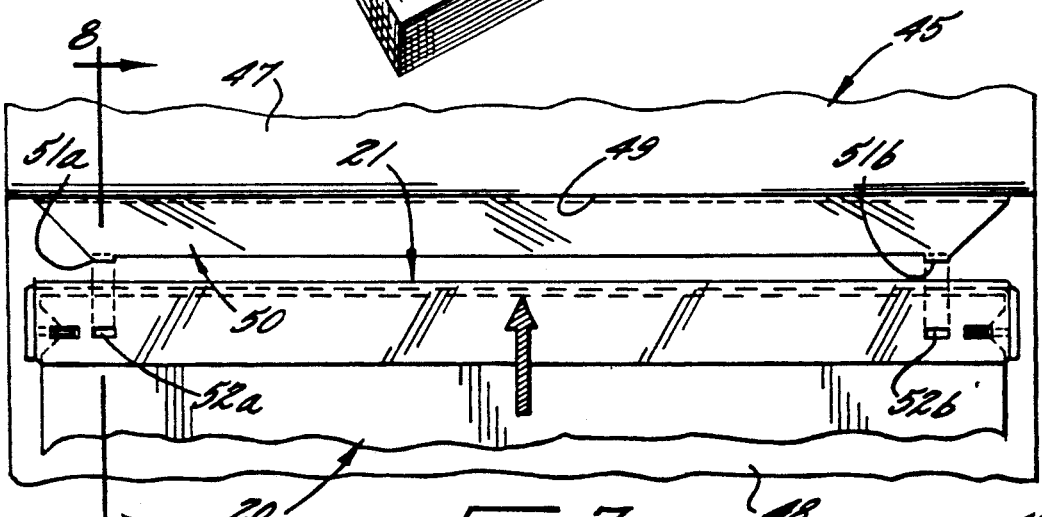
FIG. 7 is an enlarged plan view of a portion of the photograph album and protective cover taken along lines 7—7 of FIG. 6.
Figure 8:
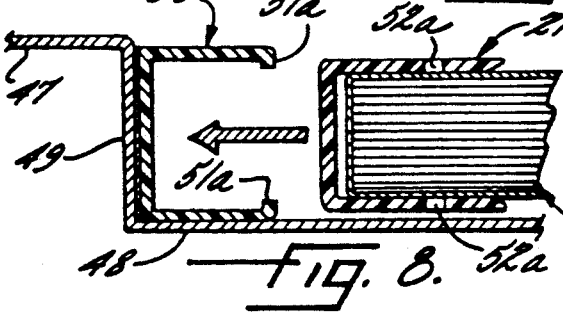
FIG. 8 is a cross-sectional view of an end portion of the photograph album and protective cover taken along lines 8—8 of FIG. 7.
Figure 9:
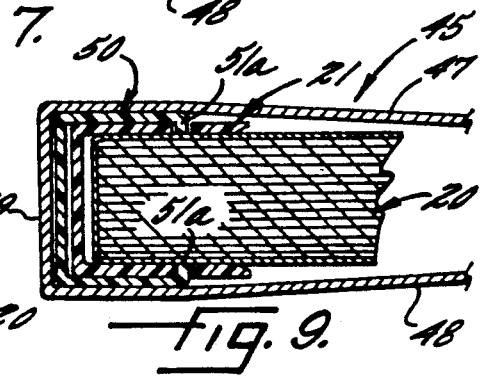
FIG. 9 is a cross-sectional view of the portion of the photograph album and protective cover in FIG. 8 shown in a fully assembled condition.

In the closed position, as illustrated in FIGS. 3-5, the retainers 25*a*, 25*b* are moved so that the free ends engage the respective slots 34*a*, 34*b* of the leaves 27. Thus, the leaves 27 are bound within the photograph album 20 while permitting ready viewing of the individual photographs 31.

As shown in FIG. 2, a retainer 25*a* includes a generally T-shaped member 36*a* which is secured to the top wall 22 of the binder 21 by an integrally molded plastic strip 37*a*. The plastic strip 37*a* forms a so-called living hinge between the retainer 25*a* and the binder 21. In addition, the retainer 25*a* also includes a portion 38*a* which forms a closed end of the binder 21 flush with the sidewalls 23*a*, 23*b* when the retainer 25*a* locked into the closed position by locking means. As shown in the illustrated embodiment, (FIG. 1), the locking means includes a pair of outwardly extending tabs 40*a* 40*b* on each T-shaped member 36*a*. The pairs of tabs 40*a*, 40*b* engage respective pairs of slots 41*a*, 41*b* in the sidewalls 23*a*, 23*b* of the binder 21.

Unlike the prior art photograph albums which used an elastic band to hold the leaves in the album together, the photograph album 20 of the invention uses a pair of hinged retainers 25*a*, 25*b*. The hinged retainers 25*a*, 25*b* are readily adaptable to assembly by automated methods rather than requiring a manual step to secure an elastic band. After the leaves 27 are inserted into the binder 21, the retainers 25*a*, 25*b* may be moved to the closed position and locked into position. As would be readily understood by those having skill in the art, the movement required to push the attached retainers 25*a*, 25*b* into the closed position may be readily implemented using automated assembly technology.

As shown in FIGS. 6-9, another aspect of the invention is a covered photograph album 45. The covered photograph album 45 comprises a photograph album 20, as described above, removably secured in a protective cover 46. The protective cover 46 includes a front panel 47, a rear panel 48, and a spine panel 49 connecting the front panel 47 and rear panel 48. The front and rear panels 47, 48 may preferably be formed of a vinyl covered paperboard. The spine panel 49 is also preferably vinyl. A retainer clip 50 is secured to the inside surface of the spine panel 49 by conventional means, such as by use of an adhesive or by heat staking.

The retainer clip 50 includes a first and second pair of inwardly extending tabs 51*a*, 51*b* adjacent opposing ends of the retainer clip 50. The binder 21 includes respective pairs of openings 52*a*, 52*b* to receive the tabs 51*a*, 51*b* of the retainer clip 50. Thus, the photograph album 20 may be readily positioned within the protective cover 45 by slightly spreading the retainer clip 50 and inserting the binder 21 into the clip 50 until the inwardly extending retainer clip tabs 51*a*, 51*b* engage the respective openings 52*a*, 52*b* of the binder 21. A pocket, not shown, may be provided, for example on the inner portion of the rear cover panel 48, for storing respective negatives for the photographs in the covered album 45.

Figure 10:
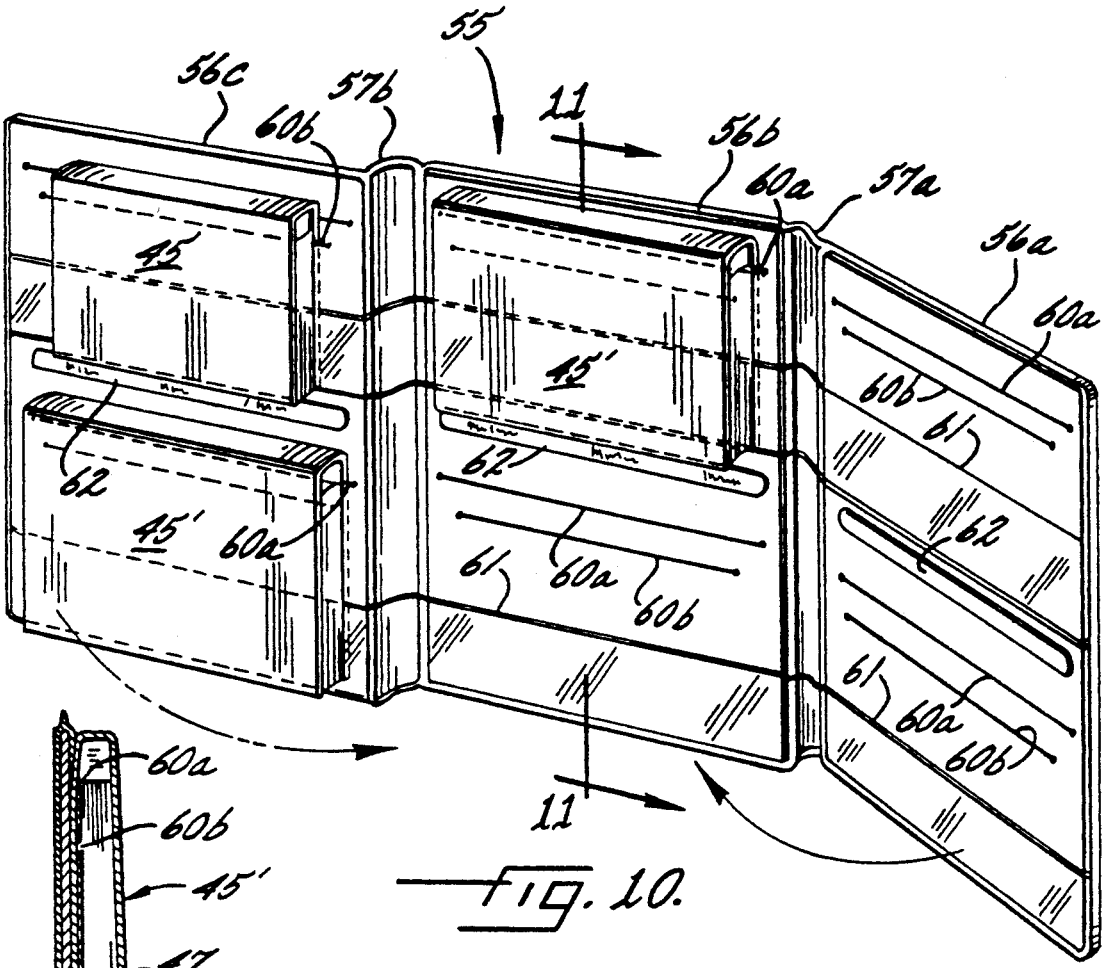
FIG. 10 is a perspective view of a trifold storage folder according to the invention with several photograph albums including the protective cover mounted therein, as shown in FIG. 6.
Figure 11:
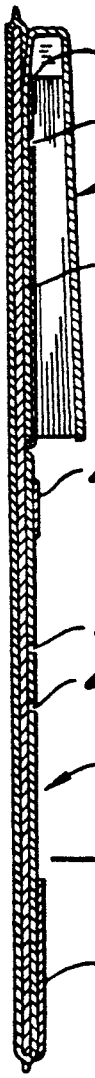
FIG. 11 is a cross-sectional view of the trifold storage folder taken along lines 11—11 of FIG. 10.
Figure 12:
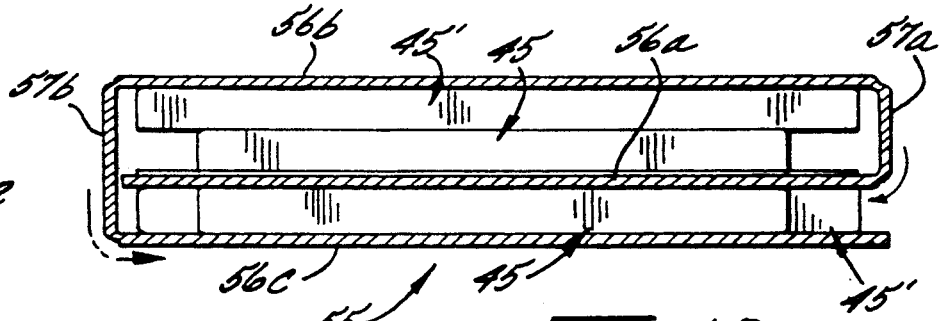
FIG. 12 is a top view of the trifold storage folder as shown in FIG. 10 in a folded condition.

Yet another aspect according to the invention is shown in FIGS. 10–12. A storage folder 55 is shown which is capable of storing one or more covered photograph albums 45 as described above. In the illustrated embodiment, the storage folder 55 is a trifold storage folder with three panels 56*a*, 56*b*, 56*c* for mounting covered photograph albums 45 thereto. Hinge panels 57*a*, 57*b* provide means for permitting folding of the storage folder 55.

Each of the storage folder mounting panels 66*a*, 56*b*, 56*c* includes a series of slots 60*a*, 60*b* therein for receiving the rear cover panel 47 of a covered photograph album 45. The upper slots 60*a* are sufficiently long to accommodate a "jumbo print-sized" album 45'. The lower slots 60*b* are shorter to therefore accommodate a standard photograph print size album 45. The standard prints are rectangularly shaped and about 3 inches in their minor dimension. The jumbo prints are about 4 inches in their minor dimension. As would be readily understood by those skilled in the art, other size prints may be readily accommodated by varying the dimensions of the storage folder 55 and the slots 60*a*, 60*b*.

The storage folder 55 may also preferably include pockets 61 for storing the negatives associated with respective covered photograph albums 45. The pockets 61 may be formed by heat sealing a transparent sheet of plastic along three sides and leaving the fourth side open to receive the negatives. In addition, the storage folder 55 may include data or indicia labels 62 for displaying identifying information for the respective photograph album 45 adjacent thereto.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A photograph album comprising:

an elongate generally U-shaped binder;

a plurality of leaves for holding photographs disposed in laterally adjacent relationship to each other, each leaf having a first edge portion received within said binder, each leaf having first and second slots within and opening outwardly from respective opposite edge portions of said leaf; and first and second retainers movably secured to said binder adjacent opposite first and second ends thereof, each of said retainers being movable between an opened position and a closed position, said retainers in the opened position permitting insertion and removal of said leaves, and said retainers in the closed position retaining said leaves within said binder by engagement within adjacent slots of said leaves.

2. The photograph album according to claim 1 wherein said U-shaped binder is made of plastic, and wherein each of said retainers is hingedly secured to a respective end of said binder by an integrally molded flexible plastic strip.

3. The photograph album according to claim 1 further comprising locking means for releasably securing said retainers in the closed position.

4. The photograph album according to claim 1 wherein said each of said retainers is generally T-shaped.

5. The photograph album according to claim 1 wherein said retainers are each generally T-shaped, and wherein said locking means comprises a pair of outwardly extending locking tabs adjacent a free end of each T-shaped retainer and corresponding openings in said binder for receiving said locking tabs therein.

6. The photograph album according to claim 1 wherein said U-shaped binder comprises a rectangular top wall and two spaced apart sidewalls depending therefrom for receipt therein of said edge portion of said leaves.

7. A photograph album comprising:

an elongate generally U-shaped binder;

a plurality of leaves for holding photographs disposed in laterally adjacent relationship to each other, each leaf having a first edge portion received within said binder, each leaf having first and second slots within and opening outwardly from respective opposite edge portions of said leaf; and first and second retainers movably secured to said binder adjacent opposite first and second ends thereof, each of said retainers being movable between an opened position and a closed position, said retainers in the opened position permitting insertion and removal of said leaves, and said retainers in the closed position retaining said leaves within said binder by engagement within adjacent slots of said leaves;

a cover for protecting said leaves in said binder, said cover comprising a front panel, a back panel, and a spine panel therebetween, and a retainer clip positioned adjacent said spine panel, said retainer clip including means for retaining said binder therein.

8. The covered photograph album according to claim 7 wherein said means for retaining said binder in said retainer clip includes a set of inwardly extending tabs on said retainer clip, and wherein said binder includes respective openings therein to receive said retainer clip tabs.

9. The covered photograph album according to claim 7 wherein said U-shaped binder is made of plastic, and wherein each of said retainers is hingedly secured to a respective end of said binder by an integrally molded flexible plastic strip.

10. The covered photograph album according to claim 7 further comprising locking means for releasably securing said retainers in the closed position.

11. The covered photograph album according to claim 7 wherein said each of said retainers is generally T-shaped.

12. The covered photograph album according to claim 7 wherein said retainers are each generally T-shaped, and wherein said locking means comprises a pair of outwardly extending locking tabs adjacent a free end of each T-shaped retainer and corresponding openings in said binder for receiving said locking tabs therein.

13. The covered photograph album according to claim 7 wherein said U-shaped binder comprises a rectangular top wall and two spaced apart sidewalls depending therefrom for receipt therein of said edge portion of said leaves.

14. A method for making a photograph album from a plurality of leaves for holding photographs disposed in laterally adjacent relationship to each other, each leaf having first and second slots within and opening outwardly from respective opposing edge portions thereof, said method comprising the steps of:

providing a generally U-shaped binder having a first and second retainer movably secured to respective opposing ends of the binder, the retainers being movable between an opened position and a closed position;

positioning the stack of leaves into the binder while the retainers are in the opened position; and moving the retainers to the closed position to engage the slots of the leaves to thereby secure the leaves in the binder.

15. The method according to claim 14 wherein the step of providing the binder channel comprises the step of forming an integrally molded flexible plastic strip between the retainers and the binder to form respective hinges therebetween.

16. The method according to claim 14 wherein the retainers include locking tabs for engagement with corresponding openings in the binder, and further comprising the step of positioning the locking tabs into corresponding openings in the binder when the retainers are moved into the closed position.

17. The method according to claim 14 further comprising the step of positioning the binder and leaves secured therein into a protective cover.

18. The method according to claim 17 wherein the step of positioning the binder in the protective cover comprises the step of securing the binder channel into a retaining clip secured to the cover, the retaining clip including a set of inwardly extending tabs for engagement therewith of a corresponding set of openings in the binder.

19. A method for making a photograph album from a plurality of leaves for holding photographs and a generally U-shaped binder, each leaf having first and second slots within and opening outwardly from respective opposing edge portions thereof, the generally U-shaped binder having a first and second retainer movably secured to respective opposing ends of the binder, the retainers being movable between an opened position and a closed position, said method comprising the steps of:

positioning the leaves in a laterally adjacent relation to each other within the binder while the retainers are in the opened position; and moving the retainers to the closed position to engage the slots of the leaves to thereby secure the leaves in the binder.

20. The method according to claim 19 further comprising the step of positioning the binder and leaves secured therein into a protective cover.

21. The method according to claim 20 wherein the step of positioning the binder in the protective cover comprises the step of securing the binder channel into a retaining clip secured to the cover, the retaining clip including a set of inwardly extending tabs for engagement therewith of a corresponding set of openings in the binder.

* * * * *